US006546690B1

(12) United States Patent
Lamberts

(10) Patent No.: US 6,546,690 B1
(45) Date of Patent: Apr. 15, 2003

(54) GLASS STRUCTURAL ELEMENT FOR CONSTRUCTING A PREFERABLY SELF SUPPORTING WALL, ROOF OR CEILING SECTION OR ELEMENT

(75) Inventor: Christoph Lamberts, Wunsiedel (DE)

(73) Assignee: Glasfabrik Lamberts GmbH & Co. KG, Wunsiedel (DE)

( * ) Notice: Subject to any disclaimer, the term of this patent is extended or adjusted under 35 U.S.C. 154(b) by 0 days.

(21) Appl. No.: 09/622,866

(22) PCT Filed: Feb. 23, 1999

(86) PCT No.: PCT/DE99/00487

§ 371 (c)(1),
(2), (4) Date: Sep. 12, 2000

(87) PCT Pub. No.: WO99/42675

PCT Pub. Date: Aug. 26, 1999

(30) Foreign Application Priority Data

Feb. 24, 1998 (DE) ..... 298 03 187 U
May 20, 1998 (DE) ..... 298 09 173 U

(51) Int. Cl.[7] ..... E04C 3/36

(52) U.S. Cl. ..... 52/731.7; 52/726.2; 52/786.1; 52/786.11

(58) Field of Search ..... 52/726.2, 731.7, 52/786.1, 786.11, 202, 203, 204.59, 309.5, 306, 307

(56) References Cited

U.S. PATENT DOCUMENTS 4,304,052 A * 12/1981 Nolte et al. ..... 34/36
4,911,743 A * 3/1990 Bagby ..... 65/31

FOREIGN PATENT DOCUMENTS

DE 3126583 * 1/1983
EP 0374891 * 6/1990

* cited by examiner

*Primary Examiner*—Carl D. Friedman
*Assistant Examiner*—Jennifer I. Thissell
(74) *Attorney, Agent, or Firm*—Max Fogiel

(57) ABSTRACT

An especially stable glass module (3) that is resistant to bending stress and releases no shards when shattered. The module can be employed to construct an area of a wall, roof, or ceiling entirely of glass and without frames or fittings of metal or another material. The module (3) consists at least two components (31 and 35) fastened total surface to total surface by cement or laminating adhesive. At least one component is a length of glass L or U structural section. The lengths are preferably of clear or ornamental glass, rolled glass, or reinforced glass, wire-reinforced glass or single-pane safety glass for instance. A wall, roof, or ceiling area composed of such modules will not need auxiliary support and will comply with strict specifications for the safety of anyone under it.

18 Claims, 6 Drawing Sheets

GLASS STRUCTURAL ELEMENT FOR CONSTRUCTING A PREFERABLY SELF SUPPORTING WALL, ROOF OR CEILING SECTION OR ELEMENT

BACKGROUND OF THE INVENTION

The present invention concerns a glass module for a preferably self-supporting region or area of a wall, roof, or ceiling. The invention also concerns an area or region in a ceiling or roof composed of such modules.

Translucent wall areas composed of individual glass modules, "glass beams", are known. Particularly stable wall areas that employ glass modules in the form of lengths of L or U section are also familiar. Wall areas of this nature can, especially when double-walled, be self-supporting, meaning that they require no additional framing or support. Although highly stable self-supporting wall areas can be constructed with glass L or U section, that stability is still not sufficient in some applications with respect to possible break-in or fire. Furthermore, no glass module is currently known that can be depended upon to be self-supporting enough in roofs or ceilings. Roof and ceiling areas entirely or partly of glass must, to ensure stability, accordingly always be employed at the present in frames, specifically frames of metal or of s similar non-breakable material. The need for stability in glass ceilings or roofs in fact is particularly significant in that such structures are exposed to severe bending forces due to their own inherent weight and often to that of snow and ice. Furthermore, anyone happening to be below such ceilings or roofs must be reliably protected from falling shards in the event that the glass shatters. If part of a glass roof shatters, a significant number of falling shards could severely and even fatally injure anyone happening to be below it.

SUMMARY OF THE INVENTION

The object of the present invention is a glass module that can be employed for a self-supporting region or area of a wall, roof, or ceiling, that will comply with all specifications with regard to strength, especially to bending resistance, defense against destructive external forces, and protection against falling shards of glass.

This object is attained in accordance with the present invention in that the glass module consists of at least two components, at least one of which is a length of glass structural section, fastened together at their surfaces by cement or a laminating adhesive.

As hereintofore mentioned, glass structural section is in itself stable enough to be employed in the structural self-supporting wall areas. The glass structural section employed for the first component of the glass module is, however, reinforced in accordance with the present invention with at least another component fastened to it surface to surface. The result is powerful augmentation with only a slight increase in weight. If one of the components is destroyed by external forces or excessive load, any shards will remain attached to the other component. The glass module in accordance with the present invention will not only provide protection against collapse, but anyone under the ceiling or roof will be safe from falling shards. This feature is of particular significance in overhead glass module.

Composite glass panes, panes, that is, that are extensively flat and cemented together from two or more basic panes, are of course known. Panes constructed along these lines also provide a certain level of protection against destructive external forces. Wall areas and in particular ceiling and roof areas of composite glass, however, do not have enough inherent bending resistance and are accordingly not safe enough to be employed without additional supports or frames. A self-supporting roof module constructed of composite glass panes could not comply with the strict specification with respect to bending resistance reliably enough to protect people from falling shards of glass. Those of skill in the art have accordingly long sought ways of rendering glass modules stable enough to inherently resist powerful bending forces without the visually disruptive frames and supports of metal or other opaque materials. This long-existing problem, however, has at last been solved with surprising simplicity in accordance with the present invention.

An extremely high-stability wall area and in particular a self-supporting ceiling or roof area can now for the first time be constructed entirely or almost entirely of glass with no worries about the safety of anyone happening to be under it by exploiting the glass modules in accordance with the present invention recited in the accompanying claims.

The length of structural section that comprises one component of the module can have various cross-sections. L or U section is particularly appropriate for flat wall, roof, or ceiling areas. /2. Embodiments of the present invention wherein one component is of U section, with two flanges or walls connected by a base or web, or of L section, more or less component a U section, that is, with only one flange connected to the base, are accordingly preferred. The first component can just be float glass, in principle ordinary window glass, or clear glass. Since, however, the glass module must be able to withstand especially high stress, a reinforced glass is particular preferable for the first component. One example of such a material is wire-reinforced glass, glass with a network of wire embedded in it. The annealed glass called single-pane safety glass, however, will be even less likely to release shards. This glass is usually a float glass that has been re-heated to a high temperature, 600° for instance, and quenched in cold air to increase its surface tension and achieve a specific inner stress and flexibility. It crumbles when struck by a pointed object. Partly stressed glass can also be employed instead of fully stressed glass. Its fragments will be slightly larger when it breaks than the "crumbs" that form from stressed glass and will accordingly adhere tighter to the laminating adhesive, although still smaller than the fragments typical of untreated glass. It is often desirable for the surface of the glass module to have a decorative pattern instead of being smooth. In such cases the first component as well can be of ornamental glass. Combinations of such materials are of course also conceivable—ornamental wire-reinforced glass for example. The web of the structural section can be of a material other than that of the flanges. The flange or flanges in the first component can in particular be of reinforced glass in order to stabilize the module, while the web, which usually includes the visible surface, can be smooth or ornamented.

The glass modules in accordance with the present invention are particularly intended for the structural of wall, roof, or ceiling areas, flat areas in other words. Due to the requirement for bending resistance over a wide span particularly characteristic of roof and ceiling areas, embodiments of the present invention wherein the extensive supporting surface of the first component, the web of a length of L section or the webs of a length of U section, that is, is reinforce are preferred. This reinforcement is attained in accordance with one advantageous embodiment of the present invention /5. in that the second component is provided with a plain surface (although other forms are also conceivable in principle) that parallels the major plane or surface of the first component and is very close to it, whereby the cement or laminating adhesive securely fastens the entire preferably plain surface of the second component to the total major plane or surface of the first component. The area that supports the major surface of the first component will accordingly be reinforced by both the cement or laminating adhesive and by the second component fastened thereby to the first.

The glass module will be particularly stable when two lengths of glass structural section are cemented together, when, that is, the second component is itself a length of such section.

It is often desirable for the glass module to be invisibly reinforced. Such reinforcement can easily be achieved if the second component fits against or into or is cemented to or into the back of the first component. In one preferred embodiment accordingly, the glass structural section that constitutes the second component is smaller than the section constituting the first component. Like the first component, /7. the second component can in this event also have either a U-shaped cross-section, with two flanges and a web between them or an L-shaped cross-section with only one flange and one web. The modules that constitute the first and the second components can be positioned one in relation to the other in various ways. In one embodiment, only their webs rest against each other, and their total surfaces are fastened together with cement or a laminating adhesive. In another embodiment, only their flanges rest against one another and are fastened together with the cement or laminating adhesive. In still another embodiment, however, the two components are fastened together with their webs and with one or both flanges resting against each other. In this event, embodiments are conceivable wherein flanges of the lengths of glass structural section that constitute components are positioned in the same or in opposite directions. The cross-sectional shapes of the lengths that constitute the components can also slope toward one another at any desired angle around an axis extending perpendicular to the flanges or to the major surface. Embodiments wherein only the flanges are cemented to each other are also conceivable in principle, at least for section wherein at least one component has a U-shaped cross-section. Hollow shapes can accordingly also be constructed and either left empty or at least partly packed with cement or a laminating adhesive. One very stable embodiment can be achieved if both components are fastened together at the major surfaces facing away from their flanges with cement or a laminating adhesive. Preferred because more cost-effective, the two components will be identically shaped lengths. The most stable form for such an embodiment will be achieved when both components are of U-shaped section. Such a glass module will then for example have a cross-section in the shape of a double T. The two lengths of glass structural section can then obviously face each other rotated 90° around an axis perpendicular to the their webs, with the flanges in the first component ensuring bending resistance in one direction and the others bending resistance in the other. When the second component is a length of glass structural section, any glass can of course also be employed that can be employed for the first component, whereby the flanges can be of a material than that of the webs. Embodiments of the present invention are also conceivable wherein the two components are of different kinds of glass, with for example the visible component being of ornamental glass and the less visible component of reinforced glass.

The second component, however, need not necessarily be a length of glass structural section. For some specific purposes only the first component must be of structural section. The second component will in this event preferably be a preferably flat plate or pane. To ensure uniform expansion subject to variations in temperature along with the usually desirable homogeneity of material in terms of attractiveness, it is preferable for the second component to be a pane of glass. Such a pane can for instance be of one of the material hereintofore mentioned as preferred for glass structural section. Another material appropriate for panes employed as second components, however, is laminated safety glass, the aforesaid materials being employed for the individual laminations. The second component employed as a pane and preferably flat (although other forms are also conceivable) can be fastened with cement or a laminating adhesive to the inner surface or outer surface of the web of the L-shaped or U-shaped first component.

The glass module in accordance with the present invention can be even stronger if three or more components are cemented together. One particularly advantageous embodiment, accordingly, /15. is characterized by a third component cemented total surface to total surface by the cement or laminating adhesive. A continuous surface without discontinuities but nevertheless extremely stable can be achieved if the second component is a large-surfaced pane of glass with the first, the third, and preferably even more components fastened adjacent against one plain side by the cement or laminating adhesive. It is preferred in this embodiment for the third and optionally the other components to be identical in shape with the first component. The most stable form, however, is one wherein the cemented-on components have a U-shaped cross-section. Very large-area but stable extents of glass can in this event be obtained by cementing several rows of components to the large-area pane. To prevent a straight potential-fracture line extending through the module, however, the components should be cemented on in separate rows.

Embodiments wherein the second component, either a length of glass structural section or a flat plate, is cemented to one side of the first component, while the third component, either a plate or a length of structural section, to the other side, opposite the first side, of the first component. The result will be a glass module with a core of structural section and the other two components cemented to each side to reinforce it.

Possibilities for the cement or laminating adhesive are in principle all materials used for the fabrication of composite glass panes. Composite glass panes, however, are usually clear, which is not always true of the glass modules in accordance with the present invention. Plastic sheet with adhesive on each side, casting resins, epoxide resins, and reinforced and even decorative adhesives are accordingly possibilities. Fabrics of woven or non-woven fiber, especially glass fiber, even wire screening, can be embedded into casting resin. The adhesive sheet can be fiber-reinforced. Decorative plastic sheet, dyed or patterned for example, can also conceivably be employed. For building areas that are exposed to the hazard of fire, it is also of advantage for the cement or laminating adhesive to include fire-prevention material, gel for instance, of the kind employed in the double-glazed systems typical of fire doors.

Since the glass modules in accordance with the present invention are designed to endure particularly high bending stresses, they can be employed without frames, supports, or other mounts. The components in accordance with the present invention can even be themselves exploited as supporting devices for other large-area glass modules fabricated in accordance with the present invention. Since the glass modules in accordance with the present invention are especially stable and fracture-resistant, it now becomes possible for the first time to provide them with "bores", preferably round holes, that is, to accommodate fasteners, especially bolts or screws. A wall, roof, or ceiling area can accordingly be fastened to other areas of a building by such fasteners. It would even be conceivable in principle for example to build an entire hothouse entirely of glass, with the exception of fasteners and seals, out of modules in accordance with the present invention. Anyone inside such a glass structure built out of state-of-the-art modules would not be safe in every situation from falling shards or larger fragments. Protection against such hazards, however, is guaranteed by glass modules in accordance with the present invention.

BRIEF DESCRIPTION OF THE DRAWINGS

Various embodiments of the present invention will now be specified by way of example with respect to the accompanying drawing, wherein.

DESCRIPTION OF THE PREFERRED EMBODIMENTS

FIGS. 1 through 9 illustrate by way of example nine embodiments of innovative glass module. Every module is composed of at least two components cemented together total surface to total surface. One component is always a length of structural section.

Figure 1:
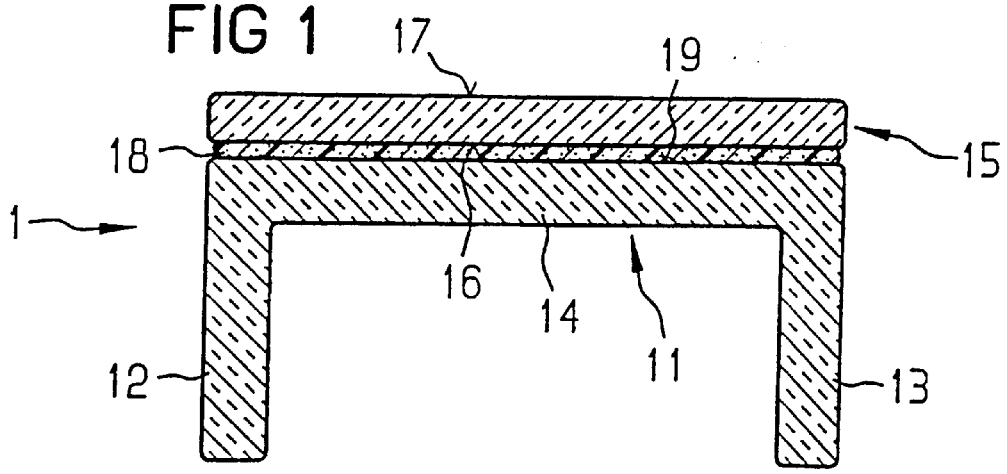
FIGS. 1 through 9 illustrate glass modules composed of at least two components cemented together.

The first component of the glass module 1 illustrated in FIG. 1 is a length 11 of glass U section with two flanges or sides 12 and 13 connected by a base or web 14. The second component is a pane 15 of glass with one plain surface 16 and another, ornamented, surface 17. Plain surface 16 is fastened with an adhesive sheet 18 to the outer surface 19 of web 14 that faces away from flanges 12 and 13.

Figure 2:
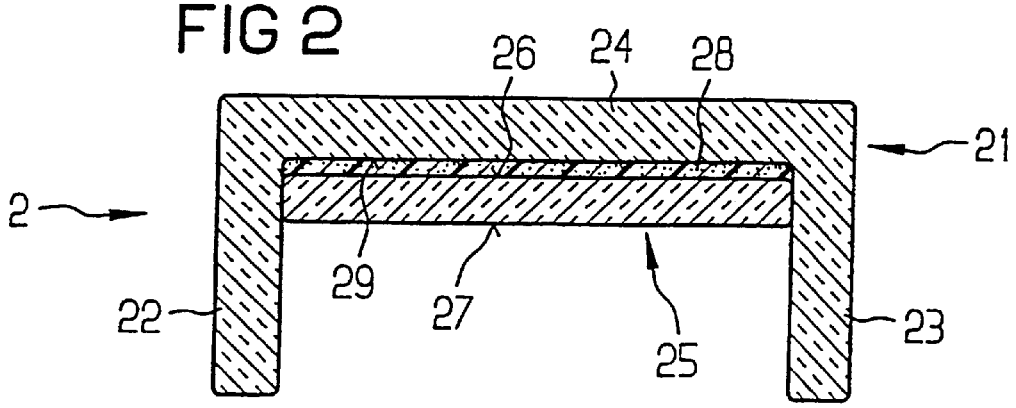
Figure 3:
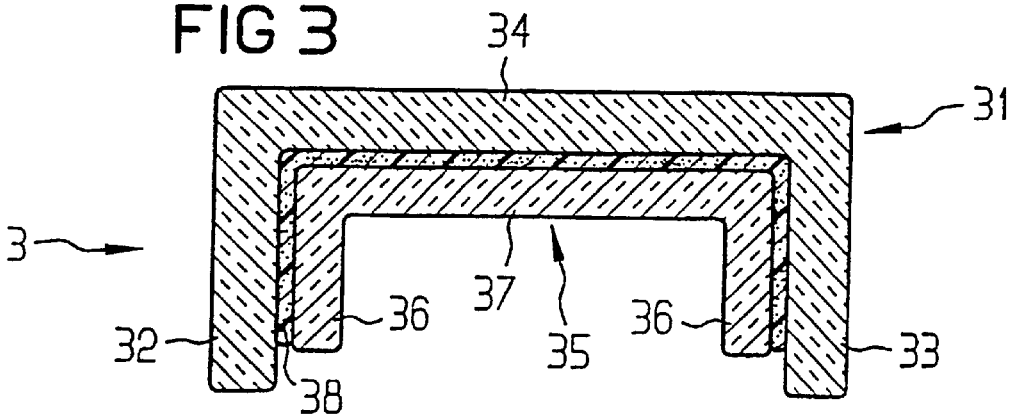

FIG. 2 illustrates another embodiment. Cemented in between the two flanges 22 and 23 of the length 21 of U section that constitutes the first component of glass module 2 is another component in the form of a pane 25 of glass. The upper surface 26 of pane 25 is plain and attached by casting resin 28 to the inner surface 29 of the web 24 that connects the two flanges of length 21, the inner surface 27 accordingly facing the flanges.

The first component of the third embodiment, illustrated in FIG. 3, is again a length 31 of U section with two flanges 32 and 33 and a web 34. The second component, however, is not a pane but another length 35 of glass U section with two flanges 36 and a web 37 connecting them. Length 35 is smaller than length 34 and fits into it. The flanges 36 of length 35 accordingly rest against the insides of the flanges 32 and 33 of length 31, web 37 resting against the inside of web 34 and length 35 accordingly fitting into length 31. The adhesive 38 that fastens the two lengths together in this embodiment is epoxy resin.

Figure 4:
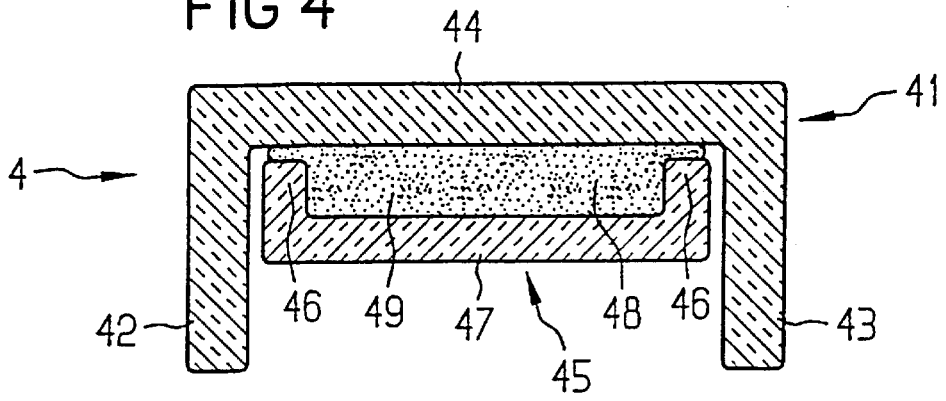

FIG. 4 illustrates a fourth embodiment of the present invention. The first component of its glass module 4 is again a length 41 of glass U section with flanges 42 and 43 connected by a web 44. Between flanges 42 and 43 is a second component in the form of another length 45 of glass U section with two flanges 46 connected by a web 47. Length 45, however, does not face in the same direction as the length 35 illustrated in FIG. 3, but in the opposite direction. The sides of the web 44 on length 41 facing away from flanges 42 and 43 and of the web 47 on length 45 facing away from flanges 46 accordingly face outward, leaving a gap 49 between the webs. Gap 49 is occupied by cement or a laminating adhesive 48 comprising or including a fire-prevention gel. This gel not only has adhesive properties but will either expand in or absorb heat. The fire-prevention gel in another embodiment, not illustrated herein, lacks adhesive properties, and flanges 46 are fastened to flanges 42 and 43 by an adhesive.

Figure 5:
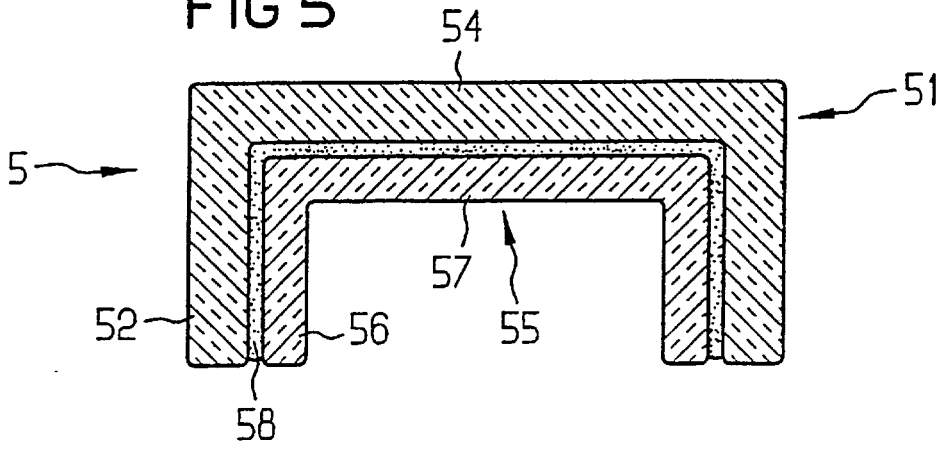

FIG. 5 illustrate a fifth embodiment. The glass module 5 in this embodiment is similar to the glass module 4 in the embodiment illustrated in FIG. 4, although the length 51 of glass U section that constitutes its first component and the length 55 of glass U section that constitutes its second component face in the same direction, its flanges 52 and 56 all pointing downward and web 57 resting against web 54. As in the embodiment illustrated in FIG. 3, length 55 accordingly fits inside length 51. The cement or laminating adhesive is again a cement or laminating adhesive 58 with the same properties as the cement or laminating adhesive 48 employed in the embodiment illustrate in FIG. 4.

Figure 6:
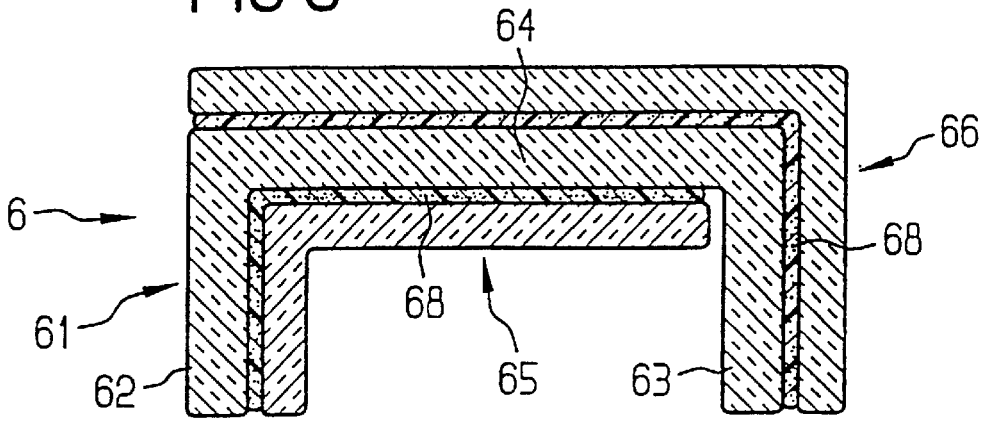

The glass module 6 in the embodiment illustrated in FIG. 6 comprises three components. The first component is again a length 61 of glass U section with flanges 62 and 63 connected by a web 64. A second component in the form of a length 65 of glass L section is fastened to the inside of length 61 by a sheet 68 of adhesive material. A third component in the form of another length 66 of glass L section is fastened to the outside of length 61 by another sheet 68 of adhesive material. To ensure sufficient reinforcement of the flanges 62 and 63 of length 61 of glass U section, one flange of the length of glass L section always rests against one of them. The web 64 of the U section is also particularly strong in this embodiment in that the web of the second length 66 of L section is cemented to its outer surface and that of the first length 65 to its inner surface.

Figure 7:
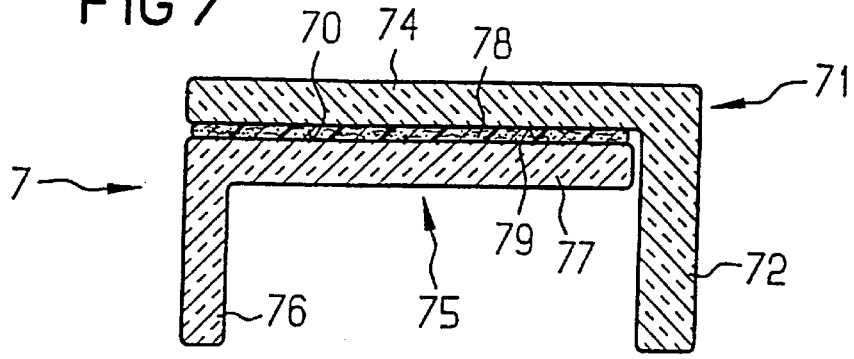

FIG. 7 illustrates a seventh embodiment with a glass module 7 with a U-shaped cross-section composed of two components with L-shaped cross-sections. The first component is a length 71 of glass L section with a web 74 and a flange 72. Fastened to the inner surface 79 of web 74 by a strip 78 of fiber-reinforced adhesive sheet is the outer, preferably plain, surface 70 of the web 77 of another component in the form of a length 75 of glass L section. A flange 76 is positioned at one end of the web 77 of length 75, lengths 71 and 75 together constituting the overall glass module 7, its web composed of webs 74 and 77 and its flanges of flanges 72 and 76.

Figure 8:
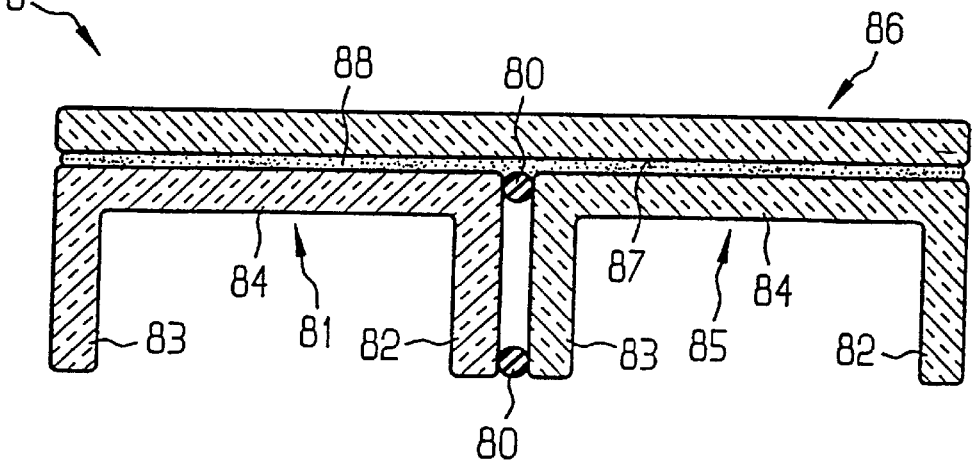

FIG. 8 illustrates an eighth embodiment. Its first component is a length 81 of glass U section, its second a pane 86 of glass, and its third another length 85 of glass U section. Pane 86 extends all the way across lengths 81 and 85. Both lengths are identical in shape and provided with similar flanges 82 and 83 connected by similar webs 84. The upper surfaces of these lengths, webs 84, are fastened to the lower surface of pane 86 by a layer 88 of adhesive. One flange 82 of one length is adjacent to the other flange 83 of the other length. Seals 80 that expand and contract in response to changes in temperature seal the gap between the two adjacent flanges.

The pane of glass in another, unillustrated, embodiment is much larger than the pane 86 illustrated in FIG. 8. Several rows of lengths 81 and 85 of glass U section are fastened to a plain surface of the pane by an appropriate layer 88 of adhesive. The adjacent rows overlap, with a web 84 in the second row occupying the position occupied by flanges 82 and 83.

The third length 85 of glass U section in another unillustrated embodiment is at a 90° angle to the first length 91 of glass U section, their flanges 82 and 83 accordingly at a right angle to each other.

Figure 9:
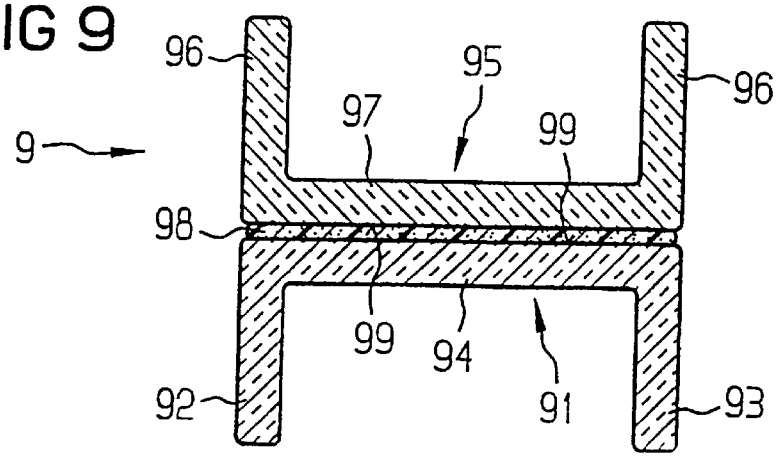

A ninth and very stable glass module 9 is illustrated in FIG. 9. It is composed of two lengths 91 and 95 of glass U section fastened together at their outer surfaces 99, which accordingly actually represent inner surfaces, by a layer 88 of adhesive, the surfaces facing away from their flanges, to create a single I beam or length of H section. The first length 91 of glass U section, which constitutes the first component is provided with two flanges 92 and 93 connected by a web 94, and the second, which constitutes the second component, with two flanges 96 connected by a web 97. The flanges all face away from surfaces 99.

All the glass modules illustrated in FIGS. 1 through 9 are very stable, can resist powerful bending forces, and provide considerable protection in the event of shattering. If, in fact, one of the at least two components 11 and 15, 21 and 25, 31 and 35, 41 and 45, 51 and 66, 61, 65, and 66, 71 and 75, 81. 85, and 86, or 91 and 95 does shatter, the shards will not fall, but will be secured in place by cement or laminating adhesive 18, 28, 38, 48, 58, 68, 78, 88, or 98. Lengths 11, 21, 31, 36, 41, 45, 51, 55, 61, 65, 66, 71, 75, 81, 85, 91, and 95 can be of ordinary window glass, clear glass or float glass that is, of a glass provided with decorations or ornament, ornamental glass, that is, or of reinforced glass, wire-reinforced glass, that is, single-pane safety glass or an otherwise annealed glass, or of a combination thereof. Lengths 11, 21, 31, 36, 41, 45, 51, 55, 61, 65, 66, 71, 75, 81, 85, 91, and 95 can be of one piece of one material. Flanges 12, 13, 22, 23, 32, 33, 36, 42, 43, 46, 52, 56, 62, 63, 72, 76, 82, 83, 92, 93, and 96 on the other hand can be made of a different glass, especially one that is stronger than the glass employed for webs 14, 24, 34, 37, 44, 47, 54, 57, 64, 74, 77, 84, 94, and 97. The cement or laminating adhesive can constitute adhesive sheets 18, 68, 98, casting resins 28 or epoxide resins 48, fire-prevention gels 48 or 58, or adhesives that include such gels, and adhesive sheets 78 reinforced with fiber or wire. Any of the cement or laminating adhesives 18, 28, 38, 48, 58, 68, 78, 88, or 98 illustrated or specified in connection with embodiments 1 through 9 can be employed instead of any of the other. Panes 15, 25, and 86 can be made of any of the materials specified in relation to lengths 11, 21, 31, 36, 41, 45, 51, 55, 61, 65, 66, 71, 75, 81, 85, 91, and 95 or of laminated safety glass. One glass that is particular preferred for any of the components is annealed glass, especially single-pane safety glass obtained by heating float glass or clear glass to approximately 600° and quenching it in cold air. A glass of this type features powerful surface tension and, at least to some extent, stress and elasticity. This type of annealed glass cam also withstand the wide fluctuations in temperature that may occur, which can easily be in the 80 K range or even higher for instance. Glass that has been entirely and completely stressed or glass that has been partly or incompletely stressed can also be employed. The tensioning can accordingly be confined to specific areas, the surface for example, or partial tensioning can be carried out by gentle heating and quenching. The embodiments 1 through 9 specified herein combine the advantages of single-pane safety glass with those of glass beams and laminated safety glass, allowing for the first time the construction of whole roof and ceiling areas of glass alone without extra frame, fittings, or other supports while conforming to particularly strict safety standards.

Figure 10:
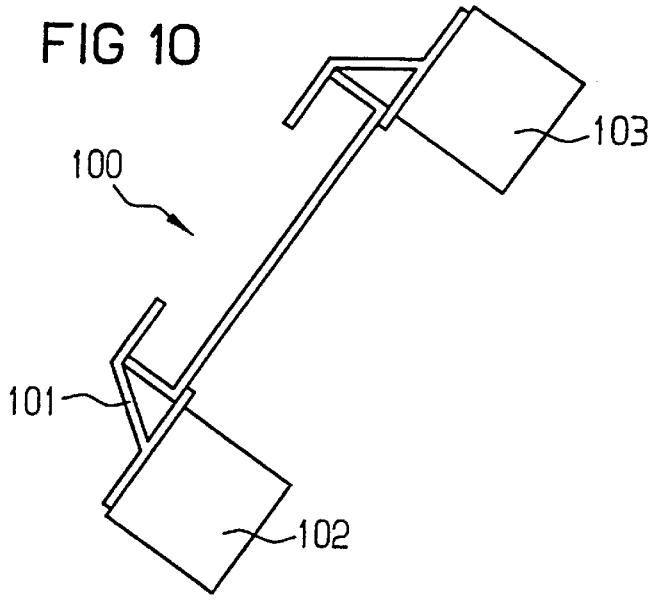
FIG. 10 is a schematic lateral view of a fastener for fastening a glass module.

As will be evident from FIG. 10, however, a wall, roof, or ceiling area including one or more glass modules 1 through 9 can of course be secured by a fitting 101 fastened to beams 102 and 103 or similar structures. Such a wall, roof, or ceiling area 100 can effectively counteract such invasive activities as break-ins for example. It will also resist bending forces. A beam 103 need not, however, be installed particularly stable in that the flow of forces can be distributed throughout wall, roof, or ceiling area 100.

Figure 11:
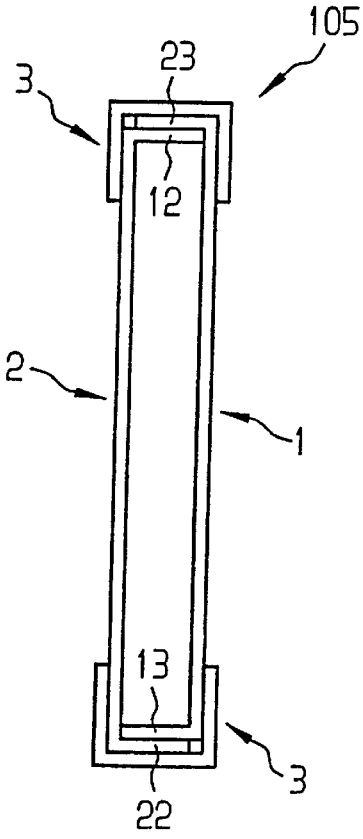
FIG. 11 illustrates an area of a roof or wall composed of several glass modules.

A wall, roof, or ceiling area, however, can, as illustrated in FIG. 11, be constructed entirely of glass, employing lengths of glass section without fittings or frames of metal or a similar material. The embodiment illustrated by way of example in FIG. 11 consists of a wall, roof, or ceiling module 105 constructed of lengths 1, 2, and 3 of glass U section. The web of length 1 measures exactly the same as the web of length 2. The flanges 12 and 13 of length 1 extend opposite the flanges 22 and 23 of length 2. The ends of the module are secured by a fitting in the form of two lengths 3 of glass U section with webs that rest against flanges 12 And 23 and 13 and 22 and with flanges that enclose the unit composed of lengths 1 and 2.

Figure 12:
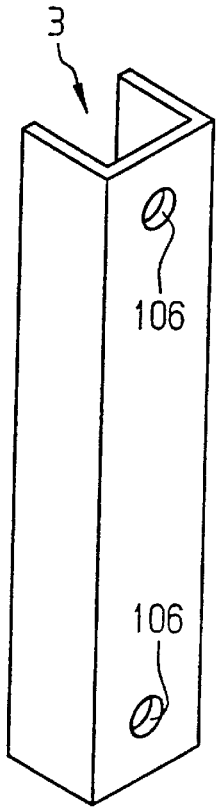
FIG. 12 is a perspective view of the glass module employed in the roof or wall area illustrated in FIG. 11.

FIG. 12 is a perspective view of the length 3 illustrated in FIG. 11 and shows holes 106 for the accommodation of unillustrated fasteners in the form of bolts, screws, or expansion screws. The holes 106 in another, unillustrated, embodiment extend through the flanges 12 and 23 and 13 and 22 of the individual lengths. An entire wall, roof, or ceiling area can accordingly be constructed of glass modules using the aforesaid fasteners to secure it to adjacent areas. Such an area will accordingly consist entirely of glass along with any cement or laminating adhesive and wire reinforcement employed therein, with the exception of the fasteners.

Figure 13:
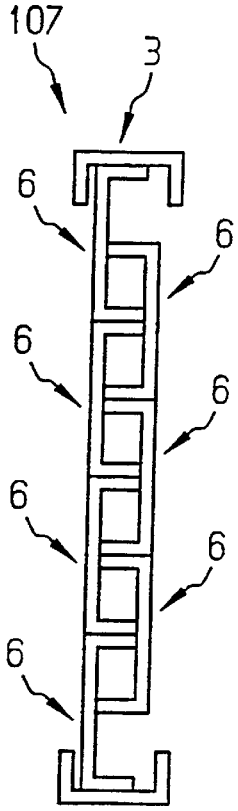
FIG. 13 is a schematic lateral view through another wall area composed of glass modules.

FIG. 13 is a section through a wall area 107 composed of several interlocking glass modules 6 of the species illustrated in FIG. 6 and held together by a fitting in the form of two lengths 3 of glass U section of the species illustrated in FIG. 12. It will be evident that even extensive wall, roof, or ceiling areas can easily be constructed by this approach. One advantage is that areas constructed of modules 1 through 9 will be double-walled, their flanges facing inward and only the outer surfaces of the webs being visible, providing a smooth and uniform look.

A particularly attractive wall, roof, or ceiling area can be constructed by boxing either two or eight modules 8 inside one another with their flanges 82 and 83 facing each other. In this embodiment, only a pane 86 of, preferably ornamental, glass will be visible at the outer surface.

Individual glass modules 1 through 9 can be cemented together or fastened together with laminating or sealing material or structural section to construct an entire wall, roof, or ceiling area. This technique is known from the state of the art employing glass brick. Even more effectively because of the added stability provided by glass modules 1 through 9, they can be fastened together by screws.

Figure 14:
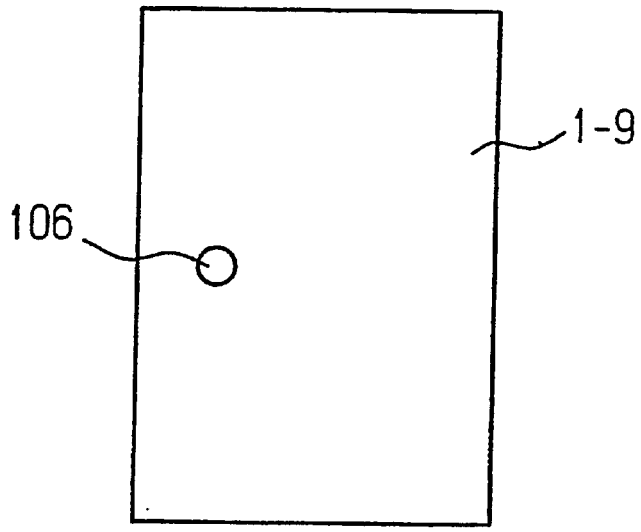
FIG. 14 is an overhead view of another embodiment of a glass module.

FIG. 14 illustrates a glass module in one of embodiments 1 through 9 provided with a hole 106 for a screw or other type of fastener.

Figure 15:
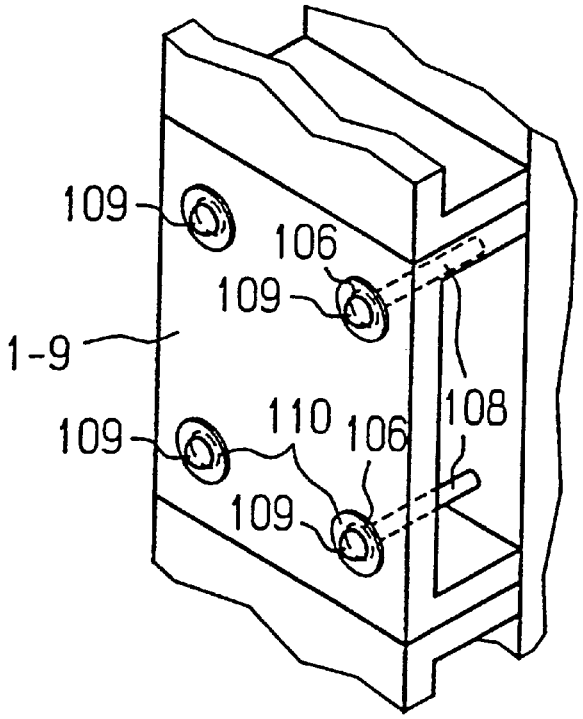
FIG. 15 is a schematic overhead view of a wall, roof, or ceiling area with a glass module secured by fasteners in the form of bolts.
Figure 16:
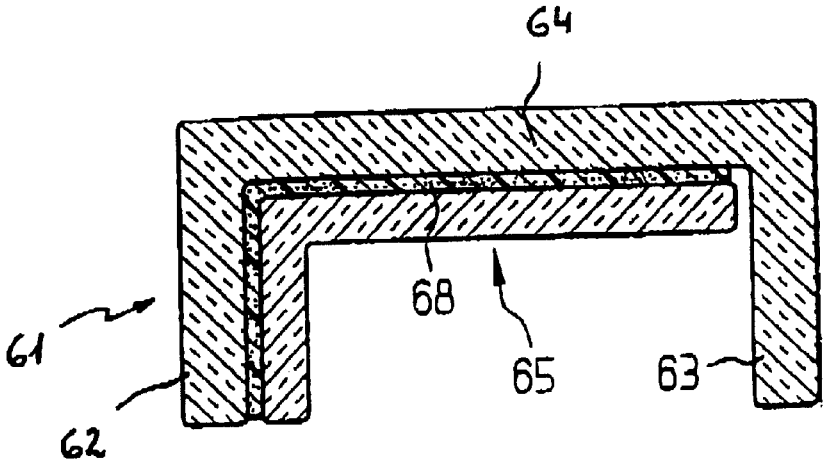
FIG. 16 is a sectional view and shows a U-shaped glass structural section.
Figure 17:
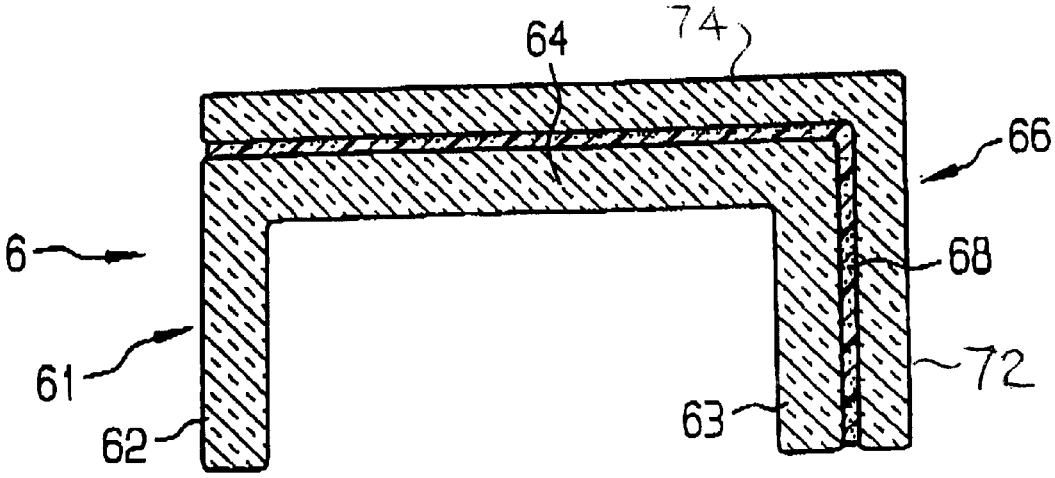
FIG. 17 is a sectional view of a glass structural member having an-L-section with a web and a flange.

FIG. 15, finally, illustrates one of embodiments 1 through 9 provided with four such holes 106. The fasteners employed in this particular embodiment are bolts 108 with heads 109 that rest against the outside of the module. Excess force is transmitted to the module by wide washers 110 to minimize local stress. The free ends of the fasteners engage the wall, roof, or ceiling of the building that the modules are mounted on.

The essential features of the glass modules specified herein and of the areas constructed of them will now be summarized with reference once again to FIG. 3.

What is claimed is:

1. A glass module for constructing a self-supporting area or region of a wall, roof, or ceiling and at least two components at least a first one of said components being a length of glass structural section, said components being fastened together with total surface of one to total surface of the other by adhesive means in form of cement or laminating adhesive said first one of said components being a glass profiled member and having a U-shaped cross-section with two flanges and a web between said flanges, said first component being of at least partly pre-stressed glass for forming a roof or ceiling section, said cement or laminating adhesive comprising double-sided adhesive tape, or epoxy; at least one round hole for accommodating fasteners in form of bolts or screws.

2. A glass module for a self-supporting roof or ceiling and at least two components, at least a first one of said components being a length of glass structural section, said components being fastened together with total surface of one to total surface of the other by adhesive means in form of cement or laminating adhesive said first one of said components being a glass profiled member and having a profiled U-shaped cross-section with two flanges and a web between said flanges, said first component being of at least partly pre-stressed glass for forming a roof or ceiling section, said cement or laminating adhesive comprising double-sided adhesive tape, or epoxy, said at least one length of glass structural section comprising a length of L-section with a web and only one flange.

3. A module as defined in claim 2, wherein the length of said first and second components rest against each other at their webs and flanges and are attached to each other by adhesive means.

4. A module as defined in claim 2, wherein a pane of said second component is fastened to said web of glass U section of said first component by adhesive means.

5. A module as defined in claim 2, wherein said first one of said components is of wire-reinforced glass, single-pane safety glass, float glass, clear glass, rolled glass or ornamental glass.

6. A module as defined in claim 2, wherein the second one of said components has a planar surface positioned level with a large surface of the first component, said adhesive means fastening total said planar surface to total of said large surface.

7. A module as defined in claim 2, wherein said second component has a length smaller than the length of said first component.

8. A module as defined in claim 2, wherein said second component is a length of glass U-section with two flanges connected by a web.

9. A module as defined in claim 2, wherein said second component has a planar plate.

10. A module as defined in claim 2, wherein said cement or laminating adhesive is a sheet with adhesive on both sides, said adhesive comprising casting resin, epoxide resin, wire-reinforced woven fabric, or means of decoration or fire-prevention gel.

11. A module as defined in claim 8, wherein said web and said flanges are of different kinds of glass.

12. A module as defined in claim 7, wherein said second component is of wire-reinforced glass, single-pane safety glass, other annealed glass, float glass, clear glass, rolled glass or ornamental glass.

13. A module as defined in claim 9, wherein said planar plate of said second component is of wire-reinforced glass, single-pane safety glass, other annealed glass, laminated safety glass, float glass, clear glass, rolled glass or ornamental glass.

14. A glass module for a self-supporting roof or ceiling and at least two components, at least a first one of said components being a length of glass structural section, said components being fastened together with total surface of one to total surface of the other by adhesive means in form of cement or laminating adhesive said first one of said components being a glass profiled member and having a profiled U-shaped cross-section with two flanges and a web between said flanges, said first component being of at least partly pre-stressed glass for forming a roof or ceiling section, said cement or laminating adhesive comprising double-sided adhesive tape, or epoxy, said section component being a length of glass U-section with two flanges connected by a web; said first and second components being attached to each other by adhesive means over surfaces facing away from their flanges and are identical in shape and in form of lengths of glass U-section.

15. A glass module for a self-supporting roof or ceiling and at least two components, at least a first one of said components being a length of glass structural section, said components being fastened together with total surface of one to total surface of the other by adhesive means in form of cement or laminating adhesive said first one of said components being a glass profiled member and having a profiled U-shaped cross-section with two flanges and a web between said flanges, said first component being of at least partly pre-stressed glass for forming a roof or ceiling section, said cement or laminating adhesive comprising double-sided adhesive tape, or epoxy, a third component fastened by adhesive means to a length of glass U-section comprising said first component.

16. A module as defined in claim 15, wherein the second component is a large pane of glass fastened to the first component and the third component by adhesive means, said third component having the same shape as the first component.

17. A glass module for a self-supporting roof or ceiling and at least two components, at least a first one of said components being a length of glass structural section, said components being fastened together with total surface of one to total surface of the other by adhesive means in form of cement or laminating adhesive said first one of said components being a glass profiled member and having a profiled U-shaped cross-section with two flanges and a web between said flanges, said first component being of at least partly pre-stressed glass for forming a roof or ceiling section, said cement or laminating adhesive comprising double-sided adhesive tape, or epoxy, a third component fastened by adhesive means to a length of glass U-section comprising said first component; said section component being fastened to one side of said first component, said third component being fastened to another side of said first component facing away from said one side.

18. A module as defined in claim 2, wherein said web and flanges are of different glasses.

* * * * *